United States Patent [19]

Gherner

[11] 4,223,594

[45] Sep. 23, 1980

[54] HYDRAULIC MOTOR

[76] Inventor: Lidio Gherner, Via Valdellatorre, 279, 10091 Alpignano, Torino, Italy

[21] Appl. No.: 892,489

[22] Filed: Apr. 3, 1978

[30] Foreign Application Priority Data

Apr. 5, 1977 [IT] Italy ..... 67743 A/77

[51] Int. Cl.[3] ..... F01B 13/04

[52] U.S. Cl. ..... 91/504; 91/499

[58] Field of Search ..... 91/499, 504–506

[56] References Cited

U.S. PATENT DOCUMENTS

| | | | |
|---|---|---|---|
| 1,539,616 | 5/1925 | Williams | 91/505 |
| 2,069,651 | 2/1937 | Ferris | 91/504 |
| 2,237,430 | 4/1941 | Higgins | 91/505 |
| 2,445,281 | 7/1948 | Rystrom | 91/499 |
| 2,452,754 | 11/1948 | Herrstrum | 91/506 |
| 2,520,632 | 8/1950 | Greenhut | 91/503 |
| 3,256,782 | 6/1966 | Ebert | 91/505 |

FOREIGN PATENT DOCUMENTS

| | | | |
|---|---|---|---|
| 2236527 | 7/1972 | Fed. Rep. of Germany | 91/499 |
| 1152134 | 2/1958 | France | 91/506 |
| 599683 | 11/1959 | Italy | 91/499 |

*Primary Examiner*—William L. Freeh

*Attorney, Agent, or Firm*—H. Dale Palmatier

[57] ABSTRACT

A hydraulic motor having a plurality of cylindrical pistons each of which is slidably mounted in a fluid tight manner along a respective cylindrical bore provided axially through a rotor keyed to a central rotatable shaft, each said piston being thrusted by a pressurized fluid with one end into contact with a flat surface of a toroidal member mounted to rotate about its own axis which is arranged at an angle to the axis of said central shaft, and rotation of said rotor causing each said piston to rotate about its own axis within the respective bore owing to said one end of each piston being shaped as a spherical bowl, the diameter of which is at least 0.7 times the radius of the respective piston divided by the sine of said angle.

3 Claims, 3 Drawing Figures

HYDRAULIC MOTOR

BACKGROUND OF THE INVENTION

This invention relates to a hydraulic motor with axial pistons.

In general, hydraulic motors of the aforesaid type comprise a plurality of pistons slidably mounted in respective cylinders provided axially through a rotor which is disposed in a casing and is keyed on to a central exit shaft. The said rotor is caused to rotate by a hydraulic fluid which acts at any time on one end of some of said pistons, urging them so that they press with their other end on a plate inclined to the axis of the rotor and generally constituted by a toroidal member rotatable about an axis and rotated by friction forces arising from contact with said pinions.

Although the aforesaid hydraulic motors are particularly efficient and are preferable in some applications to many other types of motor because of their ability to develop a relatively high specific power at a relatively low r.p.m., they suffer from certain drawbacks, the most important of which is their relatively short life. This drawback derives mainly from the fact that the forces which are exchanged between said toroidal member and each piston at their point of contact are generally parallel to the axis of the toroidal member. Consequently, the force with which the toroidal member acts on each piston produces a component transversal to the axis of the piston, which acts on this latter to cause it to preferentially rub against a generating line of the respective cylinder. This imperfect centering of the pistons in their cylinders generally leads in a relatively short time to the cylinders and pistons becoming oval, with a consequent drastic reduction in efficiency.

SUMMARY OF THE INVENTION

The object of the present invention is to provide a hydraulic motor with axial pistons which is free from the aforesaid drawback.

Said object is attained according to the present invention by a hydraulic motor with axial pistons, wherein each of said pistons is of cylindrical shape and is slidably mounted in a sealed manner along a respective axial cylindrical bore provided through a rotor housing in a casing and keyed on to a central exit shaft, which is supported to rotate about its own axis by said casing; one end of each of said pistons cooperating, under the thrust of a pressurised hydraulic fluid, with a flat surface of a toroidal member mounted to rotate about its own axis, this latter forming an angle with the axis of said exit shaft; wherein in the motor the said end of each of said pistons is substantially in the form of a spherical cap, the diameter of which is at least 0.7 times the radius of the relative piston divided by the sine of said angle.

In hydraulic motors with axial pistons, the said angle normally lies between 5° and 20°, and therefore the aforesaid characteristic means that where said angle is 5°, the diameter of said cap must be substantially at least twice the diameter of the relative piston, whereas where said angle is 20°, the diameter of said cap must be substantially at least equal to the diameter of the relative piston.

From experimental tests carried out on hydraulic motors with axial pistons constructed in accordance with the present invention, and for speeds of 0.5 to 1.5 m/sec. at the points of contact between the toroidal member and the pistons, it has been surprisingly found that there is no sign of ovalisation, even after some thousands of hours of operation.

As a result of experimental research carried out to study this phenomenon, it has been found that within said range of speeds (which corresponds to the normal range of operation of hydraulic motors with axial pistons for normally used rotor diameters), the pistons rotate about their axis during their axial reciprocating movement along their cylinders. This rotary movement induces helical laminar motion in the hydraulic fluid present within the space between each piston and its cylinder, because of which each piston is supported hydrostatically in a perfectly centered position in its cylinder, and any contact between this latter and its piston is prevented.

As a result of the aforesaid experimental research, it has also been found that the above result is valid only within a determined range of values of the specific contact pressure between the toroidal member and pistons, and that when said pressure exceeds 400 kg/mm$^2$, the forces acting on the fluid films which ensure that the pistons are hydrostatically supported become of such a value as to cause the fluid films to be squeezed in the majority of cases, to give direct contact between the pistons and their cylinders.

In one particular preferred embodiment of the aforesaid hydraulic motor, said axial bores are distributed along two circumferences coaxial to said central shaft, each of said bores housing a relative piston.

By this means, which is completely original in the case of hydraulic motors with axial pistons, it is possible, for the same delivered power and for the same external motor dimensions, to considerably increase the piston displacement, so reducing to an equal extent the specific contact pressure between the pistons and the inclined toroidal member, so that they are maintained within the previously mentioned range of specific pressures, even for relatively high powers of an extent which, in the case of motors comprising a single ring of pistons, would lead to specific powers exceeding the previously stated maximum value.

In a further particular embodiment of the present invention, said toroidal member comprises hinge means cooperating with said casing and arranged to enable the toroidal member to oscillate about an axis perpendicular to its axis of rotation and to that of said rotor, adjustment means being provided to vary said angle within a determined range starting from zero.

The variability of the toroidal member positioning allows continuous variation of the stroke of the cylinders and thus of the total piston displacement of the motor within a determined range starting from zero.

When using a variably positionable toroidal member, it is apparent that the angle between the axes of the exit shaft and toroidal member can fall below 5°, and in the limit can equal 0°. In this case, said cap will be preferably dimensioned for a value of said angle equal to a minimum of about 5°, and the motor will be either normally used for values of said angle exceeding said minimum value (said angle will become less than said minimum only during the transient states which immediately precede or follow the reduction in the piston displacement to zero), or will be made able to operate for values of said angle less than said minimum value by providing at the apex of said terminal cap of each piston a flat circular face perpendicular to the axis of the piston, and coaxial thereto, and having a diameter equal at least to 0.5 times the diameter of the piston.

BRIEF DESCRIPTION OF THE DRAWINGS

The invention will be described by way of examples with reference to the accompanying drawings, in which.

DETAILED DESCRIPTION OF THE DRAWINGS

Figure 1:
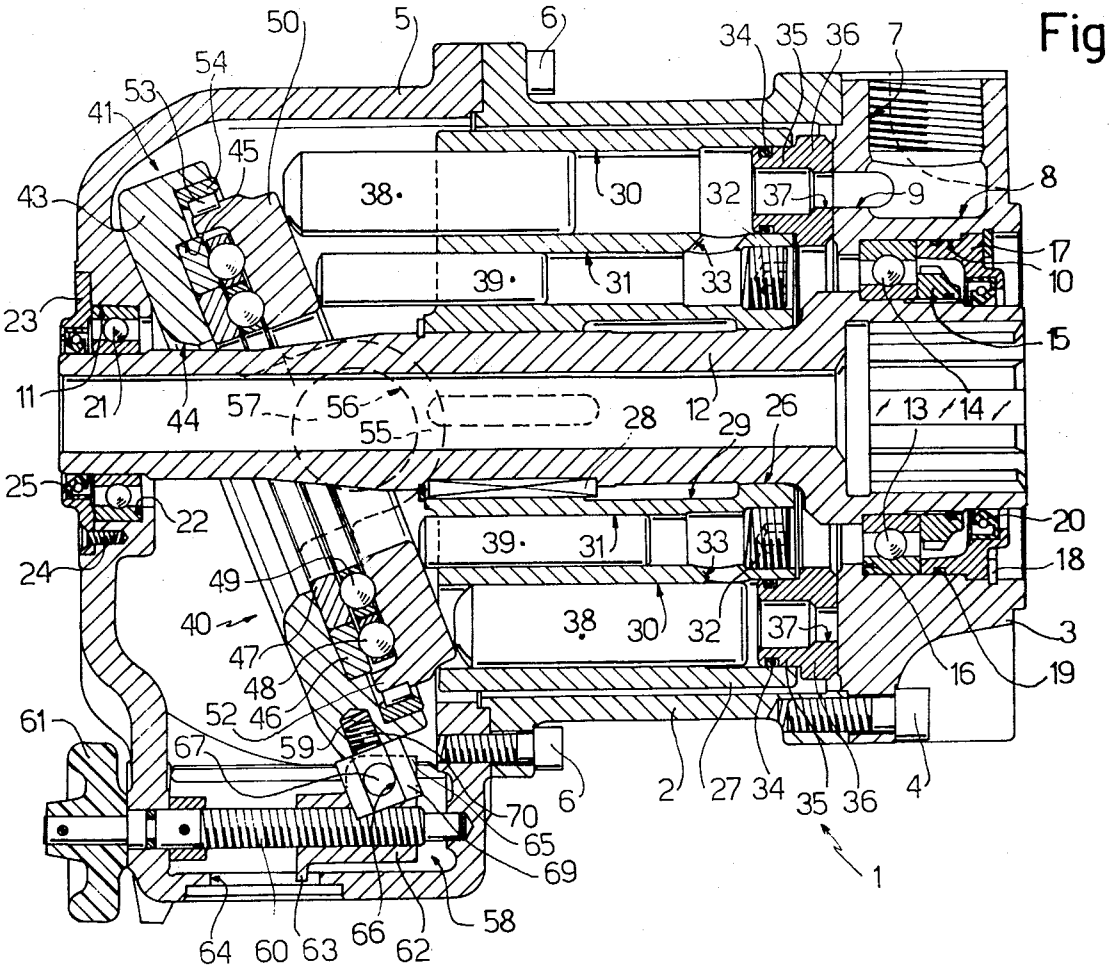
FIG. 1 is an axial section through a hydraulic motor in accordance with the present invention.

FIG. 1 shows a hydraulic motor with axial pistons indicated overall by 1 and comprising an outer casing constituted by a hollow cylindrical member 2 closed at one end by a distribution plate 3 connected to the member 2 by screws 4, and at the other end by a cup-shaped cover 5 connected to the member 2 by screws 6.

The distribution plate 3 comprises two radial holes 7 (only one of which is visible in FIG. 1) for feeding and discharging a pressurised fluid, preferably oil, respectively. Each hole 7 opens into a respective chamber 8 provided in the plate 3 and communicating with a respective axial slot 9 which in its turn communicates with the interior of the motor 1. The two slots 9 each extend along the same circumference through an arc of less than 180°.

The plate 3 and cover 5 centrally comprise two axial through bores indicated by 10 and 11 respectively, through which a hollow shaft 12 is axially fixed but rotatable. This latter is supported in the bore 10 by a radial ball bearing 13, the inner ring of which is fixed axially against an outer shoulder 14 of the shaft 12 by a ring nut 15, and its outer ring being fixed axially against an inner shoulder 16 in the bore 10 by an annular member 17 fixed axially in the bore 10 by a retaining ring 18. The annular member 17 is in sealed contact with the surface of the bore 10 via a seal ring 19, and with the surface of the shaft 12 via a seal ring 20.

The shaft 12 is supported in the bore 11 via a radial ball bearing 21, the inner ring of which is slidably mounted axially along the shaft 12, and its outer ring is fixed axially against an inner shoulder 22 of the bore 11 by an annular member 23 fixed to the cover 5 by screws 24 and cooperating in a sealed manner with the shaft 12 via a seal ring 25.

An intermediate portion of the shaft 12 extends through a central through bore 26 provided axially in a substantially cylindrical drum 27 keyed on the shaft 12 by a plurality of keys 28, each slidably fitted in a relative axial cavity 29 provided in the surface of the bore 26. The drum 27 constitutes the rotor of the motor 1, and comprises two equal sets of cylindrical axial through bores, indicated respectively by 30 and 31, distributed in two concentric rings coaxial to the bore 26 and constituting the cylinders of the motor 1. With each outer cylinder 30 there corresponds an inner cylinder 31 of smaller diameter disposed in the same diametrical plane as the corresponding outer cylinder 30. Each cylinder 31 is closed at that end facing the plate 3 by a respective threaded plug 32, and communicates with the corresponding cylinder 30 via a relative hole 33 close to the inner end of the plug 32.

That end of each cylinder 30 facing the plate 3 is engaged in a sealed manner, by way of a seal ring 34, with a respective tubular appendix 35 extending axially from a distribution ring 36 coaxial to the shaft 12 and disposed in contact with the inner surface of the plate 3. The ring 36 is traversed by a ring of axial through bores 37 each communicating with one of the appendices 35 and uniformly distributed along a circumference coaxial to the grooves 9, and of radius equal to the mean radius of these latter.

Cylindrical pistons 38 and 39 are slidably mounted in a sealed manner and rotatable about their axes in the cylinders 30 and 31. These rotors have a length exceeding three times their diameter, and their stroke is controlled by an inclined plate 40.

Figure 2:
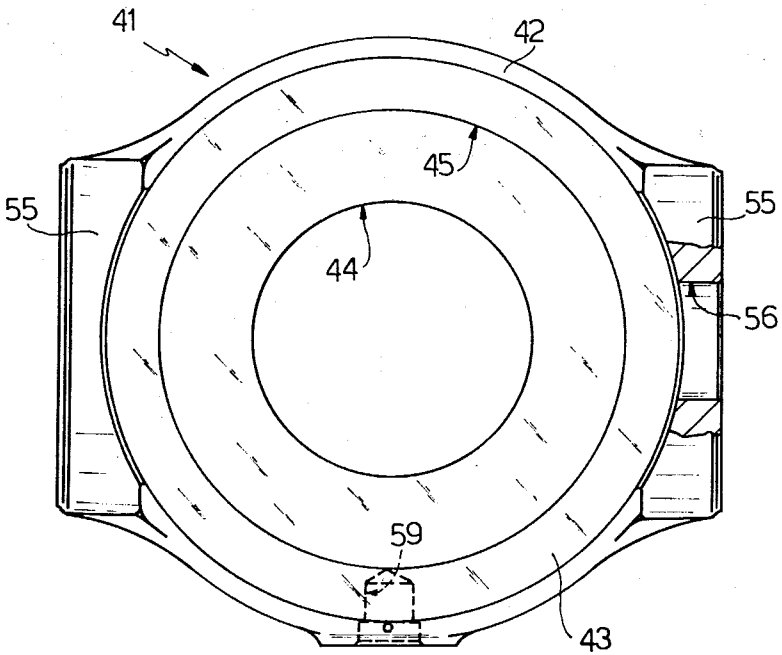
FIG. 2 is an enlarged plan view of a detail of FIG. 1.

The plate 40 is disposed in the cover 5, and comprises a swivelling support member 41 shown in detail in FIG. 2 and substantially of cup configuration. The member 41 is preferably constructed of steel and comprises a substantially lateral wall 42 extending towards the rotor 27 from the outer periphery of a substantially flat base wall 43 comprising in its centre a through bore 44 through which the shaft 12 extends with substantial radial slack. On that surface of the wall 43 facing the rotor 27, there is provided an annular groove 45, in which are housed two coplanar concentric annular members 46 and 47 which define two rolling tracks for two rings of balls 48 and 49, the two other tracks being defined on one of the end suraces of a toroidal member constituted by an annular plate 50 coaxial to the members 46 and 47, its other surface being disposed in contact with the ends of the pistons 38 and 39.

Figure 3:
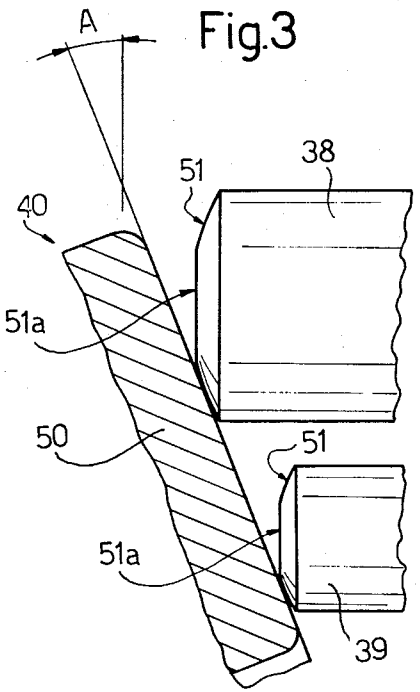
FIG. 3 is an enlarged view of a detail of FIG. 1.

As shown in detail in FIG. 3, those ends of the pistons 38 and 39 disposed in contact with the plate 50 are externally in the shape of a spherical cap 51, at the apex of which a circular flat face 51*a*, coaxial to the axis of the relative piston 38, 39 and adjoining the spherical cap 51, is formed by flattening.

With regard to the dimensions of the caps 51, the diameter d of each of them is related to the diameter D of the relative piston 38, 39 by the following relationship:

$$d.\sin A = 0.7\ D/2$$

where A is the angle between the axis of the plate 40 and the axis of the rotor 27.

The diameter of the faces 51*a* is at least equal to one half the diameter of the relative pistons 38, 39.

An annular appendix 52 extends from the outer periphery of the annular plate 50 towards the wall 43, and is coaxial to the wall 42 and is disposed internally thereto, to define the inner rolling track for axial cylindrical rollers 53, the outer rolling track for which is defined by an annular member 54 inserted into the wall 42.

From diametrically opposite points on the wall 42 there extend towards the rotor 27 two appendices or axial lugs 55 traversed by holes 56 which are coaxial to each other and perpendicular to the axes of rotation of the shaft 12 and plate 50. Through each hole 56 there is rotatably mounted a pivot 57 about the axis of which the plate 40 is arranged to swivel, urged by a control device indicated overall by 58 and shown in FIG. 1. The device 18 faces a radial bore 59 provided at a point on the outer periphery of the wall 43 disposed at an equal distance from the lugs 55, and comprises a pin 60 rotatably supported by the cover 5 and operated by an external knob 61. The pin is parallel to the shaft 12, and comprises an intermediate threaded portion coupled to a tubular nut screw 62 provided with an outer radial appendix 63 slidably extending through a slot 64 in the cover 5. The tubular nut screw 62 comprises externally a second radial appendix 65 traversed by a bore 66 having its axis perpendicular to that of the pin 60, and through which a pin 67 is rotatably mounted. This latter extends rotatably through a bore in a connection element 69 constituting the head of a screw 70 engaged in the bore 59.

By operating the knob 61, it is possible to rotate the pin 60 in one direction or the other, so as to axially displace the nut screw 62 in one direction or the other along the pin 60, and thus rotate the plate 40 in one direction or the other about the axis of the pins 57. In this manner, the inclination of the plate 40 to the axis of the shaft 12 can be varied from zero, corresponding to zero piston displacement, to that shown in FIG. 1, corresponding to a maximum piston displacement of the motor 1.

According to a first non-illustrated modification, the screw-nut screw coupling 60, 62 can be operated by a stepping motor instead of manually by the knob 61. Alternatively, the said screw-nut screw coupling can be replaced by a hydraulic jack (not shown) disposed between the cover 5 and connection element 69. The said hydraulic jack can be operated directly or can constitute the secondary cylinder of a hydraulic servocontrol. According to one non-illustrated embodiment, the said hydraulic jack can be connected directly to the feed of the hydraulic operating fluid for the motor 1, and be arranged to increase the inclination of the plate 40 against the action of a return spring (not shown).

By this means, it would be possible to vary the piston displacement of the motor 1 as a function of the operating pressure, so as to maintain the power delivered by the motor 1 substantially constant.

At any moment during the operation of the motor 1, two of the bores 37, in particular the bores 37 communicating with those cylinders 30, one of whose pistons is disposed within a determined distance about its top dead centre and the other is disposed within a determined distance about its bottom dead centre, are in communication neither with the discharge slot 9 (shown in FIG. 1) nor with the feed slot 9 (not shown in FIG. 1). Of the remaining bores 37, a first half communicates with the feed slot 9, and the second half with the discharge slot 9.

The pressurized oil, fed by a central hydraulic unit (not shown) to the feed bore 7 (not visible in FIG. 1), passes through the feed slot 9 to the first said half of the cylinders 30, and passes through the bores 33 in these latter to the corresponding cylinders 31, to apply an outward thrust to the respective pistons 38 and 39, which, when the axis of the plate 40 is at an angle other than zero to the axis of the shaft 12, move with their surface 51 in contact with the inclined plane defined by the plate 50, to make a cross traverse and impart rotary motion to the plate 50, the rotor 27 and shaft 12.

When they have finished their outward stroke, the pistons 38 and 39 are brought into communication with the discharge slot 9 by the rotation of the rotor 27, and undergo their return stroke, discharging through the discharge bore 7 the oil which had previously filled the respective cylinders 30 and 31. It should be noted that the oil discharged through the discharge bore 7 is under a certain pressure, which is sufficient to keep the pistons 38 and 39 in contact with the plate 50 during their return stroke.

Analysing the movement of the pistons in contact with the plate 50, it can be seen that if they were keyed on to the rotor 27, they would make one complete revolution about the axis of the shaft 12 for each revolution of the rotor 27, and their point of contact with the plate 50 would describe a circumference on the relative cap 51 for each revolution of the rotor 27. However, as the pistons can rotate inside their respective cylinders, the rotary movement of the said points of contact about the caps 51 tends to rotate the pistons about their axis. Because of the size of the caps 51, this rotation, which would otherwise be erratic and casual, becomes such as to ensure that a laminar motion is set up in the hydraulic fluid present between the pistons and their cylinders, to hydrostatically support the pistons. In this respect, because of the size of the caps 51, the point of contact between each piston and the plate 50 is always disposed at a distance from the axis of said piston which is at least equal to the radius of the relative face 51*a*, and the friction forces generated at the said point of contact always have an arm which is sufficient to ensure rotation of the relative piston about its axis.

Obviously, the faces 51*a* are necessary only if the motor 1 has to operate with very small angles A which are generally less than about 5°, because only in this case are the said points of contact disposed on the join between the caps 51 and their faces 51*a*.

What I claim is:

1. A hydraulic motor comprising a casing; a central shaft extending through said casing and supported by the latter to rotate about its own axis; a rotor housed in said casing and connected to said central shaft for rotation therewith; a plurality of cylindrical bores provided axially through said rotor; a cylindrical piston slidably and rotatably mounted in fluid tight relation to each of said bores; a toroidal member mounted within said casing to rotate about its own axis, and forming an angle with the axis of said central shaft; said toroidal member having a flat surface facing said rotor; a support member supporting said toroidal member in the casing and having hinge means cooperating with said casing and permitting the toroidal member to oscillate about an axis perpendicular to its axis of rotation and to the axis of the rotor; adjustment means being provided for varying said angle by tilting the support member on said hinge means to change the orientation of said flat surface with respect to the axis of the central shaft; one end of each of said pistons cooperating with said flat surface of the toroidal member under the thrust of a predetermined hydraulic fluid in the bore, said one end of each of the pistons having an end face of substantially spherical shape, and said one end of each of said pistons also has a flat circular face traversing the axis of the piston and a significant portion of the end of the piston; said flat face being perpendicular to the axis of the piston and coaxial thereto.

2. A hydraulic motor comprising a casing; a central shaft extending through said casing and supported by the latter to rotate about its own axis; a rotor housed in the casing and connected to said central shaft for rotation therewith; a plurality of cylindrical bores provided axially through said rotor; said axial bores being distributed along two circumferences coaxial to said central shaft, each of said axial bores being disposed on one of said circumferences and corresponding to an axial bore on the other circumference, the axes of each pair of corresponding bores being disposed in the same diametrical plane of said rotor, and the bores of each pair of said bores communicating with each other through a port; a plurality of cylindrical pistons each slidably and rotatably mounted in a fluid type relation in a respective bore; and a toroidal member mounted within said casing to rotate about its own axis, this latter forming an angle with the axis of the central shaft; said toroidal member having a surface facing said rotor, said surface defining a pair of flat annular surface portions concentric of each other and confronting the ends of the pistons in the two circumferences of axial bores; and one end of each said piston cooperating with said flat surface under the thrust of a pressurized hydraulic fluid in the rotor bores; said one end of each piston having an end face of substantially spherical shape, said ports between adjacent bores being disposed in proximity to that of the ends of the bores opposite to the one facing said toroidal member.

3. A motor as claimed in claim 2, wherein of those ends of the bores of each of said pair of bores which are opposite to those ends facing said toroidal member, one communicates with distribution means for said pressurised fluid whereas the other is closed.

* * * * *